United States Patent [19]

Krings

[11] Patent Number: 4,472,090

[45] Date of Patent: Sep. 18, 1984

[54] SUPPORTING BEAM FOR EXCAVATING, TRENCHING OR LIKE CONSTRUCTION APPLICATIONS

[76] Inventor: Josef Krings, Hans-Boeckler-Str. 23, D-5138 Heinsberg-Oberbruch, Fed. Rep. of Germany

[21] Appl. No.: 129,325

[22] Filed: Mar. 11, 1980

[51] Int. Cl.[3] ..... E02D 5/00; E02D 17/08; E04G 3/00; E04G 25/00

[52] U.S. Cl. ..... 405/272; 405/282; 248/228; 248/354.5

[58] Field of Search ..... 405/272–276, 405/282, 284; 248/72, 228, 310, 354 P, 354 R, 357, 542, 644; 211/105.3, 105.4, 123

[56] References Cited

U.S. PATENT DOCUMENTS

| | | | |
|---|---|---|---|
| 1,264,261 | 4/1918 | Blankenship | 248/357 |
| 1,756,716 | 4/1930 | Whitney | 248/354 R |
| 2,146,759 | 2/1939 | Panowitz | 248/354 P |
| 2,437,344 | 3/1948 | Behlmann | 248/228 |
| 2,961,270 | 11/1960 | Renfroe | 248/228 |
| 3,219,337 | 11/1965 | Hagen | 248/72 |
| 3,642,239 | 2/1972 | Zeiler | 248/310 |
| 3,929,078 | 12/1975 | Sears | 248/228 |
| 4,054,033 | 10/1977 | Pillosio | 405/282 |
| 4,056,940 | 11/1977 | Fisher | 405/282 |

FOREIGN PATENT DOCUMENTS

| | | | |
|---|---|---|---|
| 1194121 | 6/1965 | Fed. Rep. of Germany | 405/282 |

*Primary Examiner*—Cornelius J. Husar
*Assistant Examiner*—Nancy J. Stodola
*Attorney, Agent, or Firm*—Diller, Ramik & Wight

[57] ABSTRACT

This disclosure is directed to a supporting beam, particularly adapted for bracing purposes in construction applications, such as trenching, shoring, and the like, and includes at least one elongated member having axially opposite end portions each carrying a generally C-shaped bracket pivoted thereto with the axes of the pivots being generally parallel to a groove defined between end walls of the C-shaped brackets, each bracket including a pair of legs and a bight therebetween, and first and second clamping means carried by the bight for selectively clamping an element to be braced against inner or outer surfaces of the end walls of the C-shaped brackets.

21 Claims, 8 Drawing Figures

SUPPORTING BEAM FOR EXCAVATING, TRENCHING OR LIKE CONSTRUCTION APPLICATIONS

The present invention is directed to a supporting or bracing beam which is particularly adapted for bracing or supporting construction plates, sheeting piles or similar construction walls which are normally utilized in pairs and are held in spaced relationship by spreaders installed transverse to the length of an associated trench.

It is common in large excavations to use so-called L-shaped plate material from which is made sheeting or trenching piles whose lateral vertical sides are generally of a T-shaped or C-shaped cross-section forming vertical guides which may be engaged by similarly complimentary contoured braces. Such sheeting piles or trenching piles are generally placed in a trench in front-by-side and in superimposed relationship, depending upon the depth of the trench, and are interlocked at adjacent contiguous vertical and/or horizontal edges. These same trenching or sheeting piles are also held in spaced relationship from each other by braces to resist the collapse of associated trench walls or like excavations.

A simpler version of such heating piles, trenching piles or building walls are equiped with vertical C-shaped guides or box beams which may receive associated spreaders or guide heads of building walls which are transverse (generally normal) to the longitudinal axis of an associated trench. As such building walls permit preassembly to form rectangular closed building walls, they are normally termed "excavation walls" in the trade. Such excavation walls are generally connectedly rigidly at least in pairs by means of spreaders or the like and are emplaced in such pairs in pre-excavated trenches.

The difficulty resides not simply in bracing by spreaders or the like such pairs of excavation walls, sheeting piles or trenching piles from each other to prevent the walls of a trench from collapsing, but to effect the support of such excavation walls in areas that which a trench is crossed by conduits or the like, and it is impossible to utilize excavation walls in these areas. In other words, the excavation walls are generally placed one on opposite sides of the conduit and though they are held in place by spreaders or spanners normal to the longitudinal axis of the trench, those excavation walls on the same side of the trench but on opposite sides of the conduit have not been interconnected in a supporting fashion. Heretofore in such cases the trenching excavation had to be interrupted and temporary planking was utilized in the old conventional manner which is obviously laborious, time consuming, not particularly safe, and generally interferes with overall construction deadlines.

Similar problems to a conduit crossing a trench transversely results where a trench of a predetermined width suddenly becomes larger in width which is simply incapable of being accommodated for, if transversely narrow trenching walls are unavailable.

In keeping with the foregoing, it is a primary object of the present invention to provide a suitable supporting beam or brace which can stand the distances between adjacent excavation walls, construction walls, or the like, as, for example, excavation walls spaced from each other on the same side of a trench between which might pass a conduit, the supporting beam preferably being telescopic in nature and having pivoted thereto at opposite ends generally C-shaped brackets defined by a bight, a pair of legs, and end walls opposing each other to define therebetween a groove with the groove having a longitudinal axis parallel to the axes of the pivotal connection between the C-shaped brackets and the associated supporting beam whereby the supporting beam can be connected between and in supporting relationship to spaced aligned construction walls or excavation walls on the same side of an associated trench.

Still another object of this invention is to provide a novel supporting beam of the type aforesaid including clamping means carried by each of the bights for clampingly securing each C-shaped bracket to an associated guide head or plate of the excavation wall or construction wall.

A further object of this invention is to provide a novel supporting beam in which additional clamping means are associated with each bight of each C-shaped bracket in order that either clamping means may be utilized to draw a guide head or plate of an excavation wall against and in clamping relationship to an outer surface of the end walls or against an inner surface of the inner surface of the end walls of the C-shaped brackets for clamping purposes.

By providing a novel supporting beam of the type aforesaid, the conventional "soldier beams" found in wood construction are totally replaced while the major advantage obtained from the construction of the supporting beams of this invention is that they may be fastened by means of the C-shaped brackets to the vertical C-shaped or T-shaped end beams or box beams of excavation walls or to the C-shaped box beams of excavation walls or plates or like trenching, and in this manner they are rigidly connectable in a continuing or ongoing fashion to buildup relatively large trenching areas. Furthermore, the pivoting associated with each C-shaped bracket and its preferably telescopically extensible bracing member allows most any type of construction to proceed at virtually any angle, as might vary when trenching direction or excavation is changed. Due to such pivoting, the supporting beams of this invention might, for example, be utilized in areas where a narrow trench widens and then renarrows again to support and interconnect the excavating walls along the narrowing and widening trenches.

With the above and other objects in view that will hereinafter appear, the nature of the invention will be more clearly understood by reference to the following detailed description, the appended claims and the several views illustrated in the accompanying drawings.

IN THE DRAWINGS

FIG. 1 is a top plan view of a novel supporting beam constructed in accordance with this invention, and illustrates an enlongated member received telescopically in associated end portions, each of which is pivoted by a pivot pin to an associated C-shaped connecting bracket with a bight portion of a bracket carrying a clamping screw to secure each C-shaped bracket to an associated construction or excavation wall or trenching plate.

Figure 1:
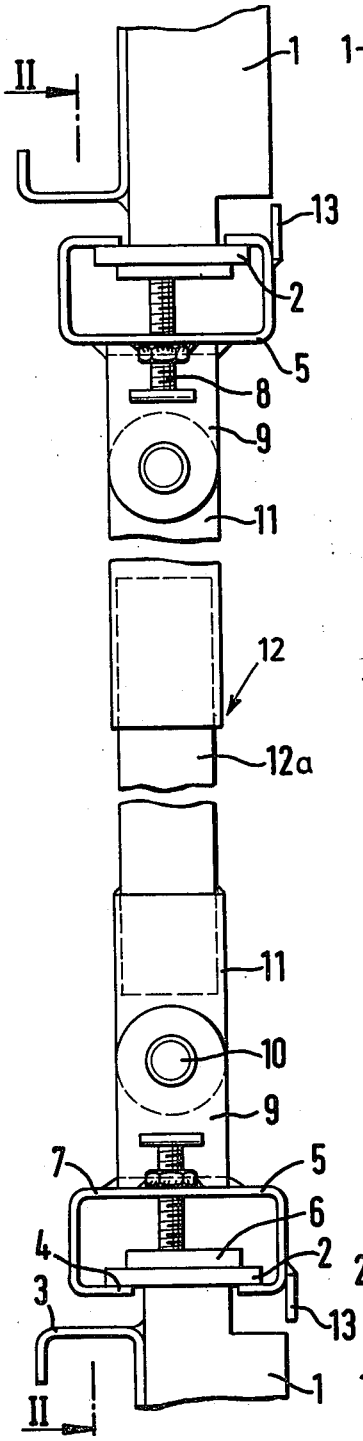
Figure 2:
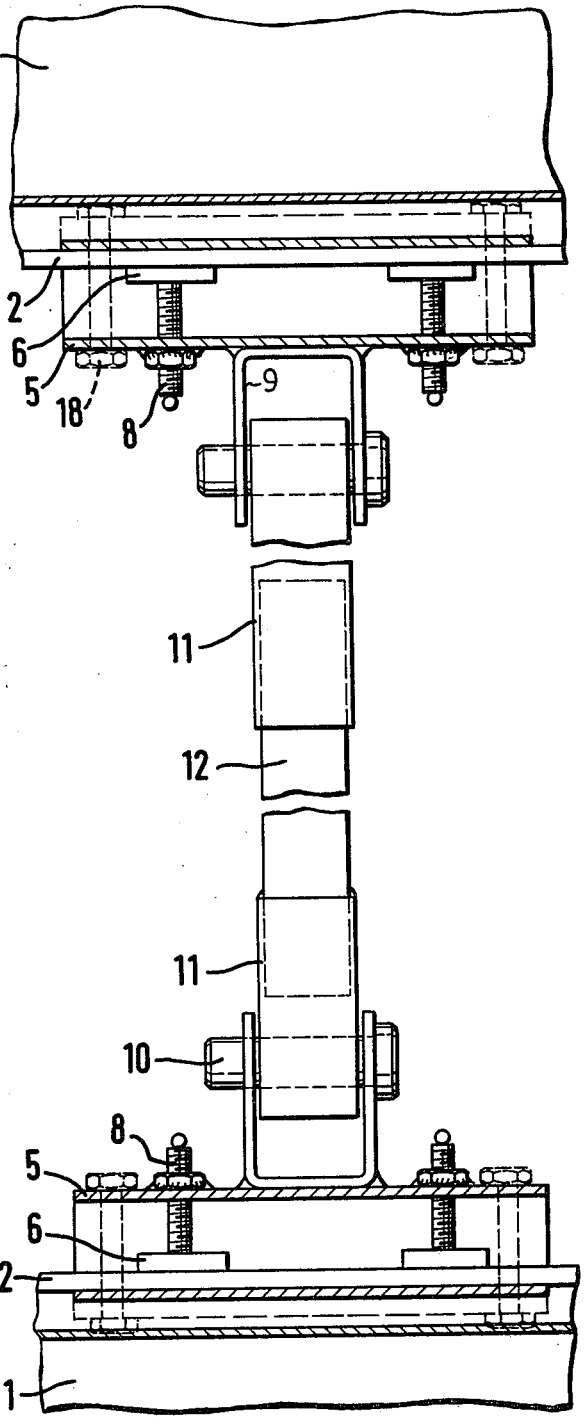
FIG. 2 is a cross-sectional view taken generally along line II—II of FIG. 1, and illustrates the elongated nature of each of the C-shaped brackets and the manner in which the pivot pins are generally parallel to the longitudinal axes of the C-shaped brackets and the grooves or channels associated with each.

A novel supporting beam constructed in accordance with this invention is generally designated by the reference numeral 12 in FIGS. 1 and 2 and is shown positioned between construction walls or excavation plates 1, 1. The right hand side of the excavation plates 1, 1 in FIG. 1 are the outside thereof which are normally immediately adjacent the wall of a trench, while the left side of the same plates 1, 1 are inside the trench and suitable conventional spreaders (not shown) are received in the guides 3 carried by the excavation plates 1 to hold oppositely unillustrated excavation plates against the opposite unillustrated side of the trench in FIG. 1. Each of the excavation plates or walls 1 also include vertical bars, guide heads or braces 2 which are welded or otherwise rigidly carried by the excavation walls 1 and generally run the length thereof from top to bottom on both sides of each of the excavation plates 1. It is to these guide heads or plates 2 that the supporting beam 12 is interconnected to reinforcingly brace and support the excavation plates 1, 1 from each other in the manner most readily apparent in FIGS. 1 and 2.

The supporting beam 12 includes an elongated member **12*a* having ends (unnumbered) telescopically received in tubular elongated members or end portions 11, 11. Suitable adjusting pins and alignable bores are formed in the members 11, 11 and 12 in order that the elongated member 12*a* may be adjusted in its length relative to the end portions 11, 11 thereof. This permits the supporting beam 12 to be positioned at the selected distances between excavation walls 1, 1** which may, of course, be spaced different distances from each other depending upon the particular construction under way.

The end portions 11, 11 are connected by pivot pins 10, 10 to C-shaped brackets 9, 9 (FIG. 2) whose bight (unnumbered) are welded or otherwise fixed to bights 7 of generally elongated (FIG. 2) C-shaped clamping brackets or brake shoes 5, each of which includes a pair of legs (unnumbered) generally normal to the bight 7 and terminal end walls 4, 4 in planer opposing relationship to each other which define therebetween a groove or slot (unnumbered). Clamping means in the form of bolts 8 are threaded in nuts (unnumbered) welded to the bight 7 of each of the C-shaped brackets, and each bolt 8 carries a clamping jaw or plate 6 which clamps the guide head or strip 2 of each excavation wall 1 against inner surfaces (unnumbered) of each of the terminal walls 4 of the C-shaped brackets, thus rigidly connecting the supporting beam 12 between the excavation plates 1, 1 in the manner clearly apparent from FIGS. 1 and 2. A cover plate 13 is welded to one of the legs of each of the C-shaped brackets and covers a gap between each excavation wall 1 and its associated guide head or strip 2. The same cover plate 13 is used for alignment purposes in the manner best shown in FIG. 5.

Figure 3:
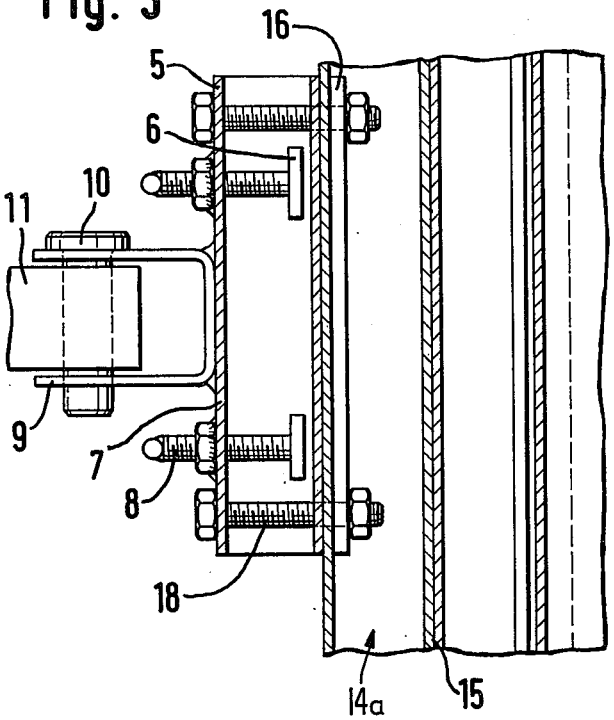
FIG. 3 is a fragmentary vertical sectional view taken generally along line III—III of FIG. 5, and illustrates the manner in which another clamping means secures a C-shaped bracket to an opposing C-shaped box beam which is in turn connected to an oppositely facing C-shaped box beam which is in turn connected to an excavation wall or plate.
Figure 4:
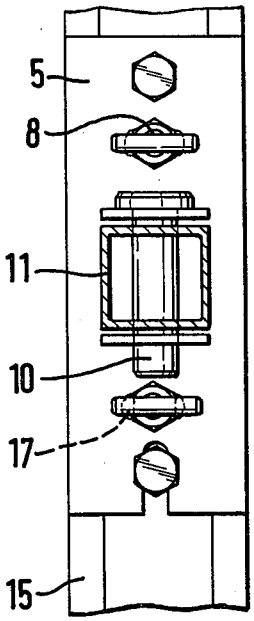
FIG. 4 is a side elevational view looking from left-to-right in FIG. 3, and illustrates four clamping bolts associated with the C-shaped bracket of FIG. 3.
Figure 5:
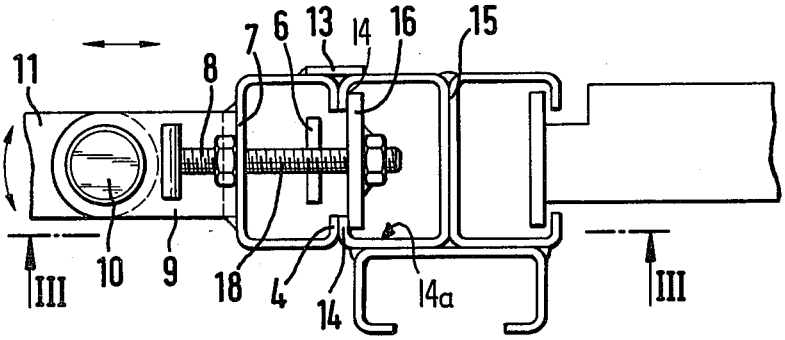
FIG. 5 is a top plan view looking downwardly in FIG. 3, and more clearly illustrates one of the the bolts for drawing a clamping jaw or plate against one of the vertical C-shaped box beams to draw the same into clamping engagement with the end walls of the C-shaped bracket of the supporting beam of this invention.

Referring specifically to FIGS. 3 through 5 of the drawings, the same construction as that heretofore described relative to FIGS. 1 and 2 is illustrated except that in addition to the clamping means or clamping bolts 8, 8 and the associated jaws 6,6, additional clamping means in the form of bolts 18 are shown in FIGS. 3 through 5 with the bolts being received through apertures (unnumbered) in a securing plate 16 which spans legs 14 of a generally inverted C-shaped vertical box beam **14*a* forming part of an excavation plate or construction plate (unnumbered) with a C-shaped vertical guide plate or box beam 14*a* of the latter being connected by a weld to the inverted C-shaped box beam 14*a*, generally along the common bight wall 15 therebetween. Thus, as the bolts 18 are tightened, the plate 16 is drawn to the left to clamp the legs 14 of the box beam 14*a* against the outer surfaces (unnumbered) of the end walls 4 of the C-shaped clamping bracket 5 of the supporting beam 12. Thus, depending upon the particular construction of the excavating plate and its associated box beam 14, one might utilize the bolts 8 and their associated clamping jaws 6 (FIGS. 1 and 2) or the bolts 18 and their associated clamping plates 16. Also, the bolts 8 or 18 might preferably be housed in horizontally elongated slot 17 (FIG. 4) to permit limited adjustment while horizontal adjustment might be achieved by elongating the slots associated with the bolts 8 or 18 vertically, as is indicated by the elongated slots associated with the lowermost bolt 18 in FIG. 14 opening through the lowermost edge of the bight 7**.

Figure 6:
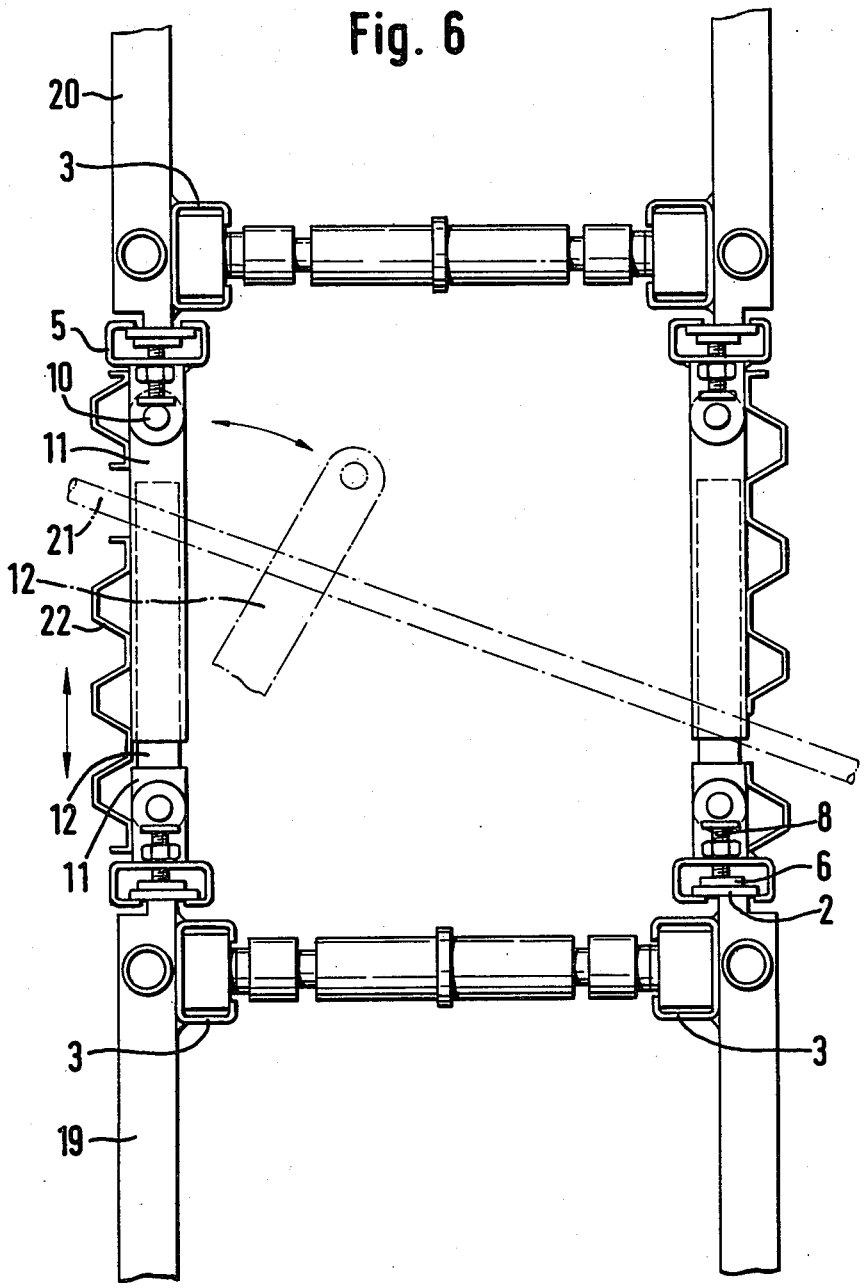
FIG. 6 is a top plan view illustrating two of the supporting beams of this invention, and illustrates each supporting beam clamped by its associated C-shaped brackets and bolts to coplanar excavation walls or trenching piles, and a conduit is shown in phantom outline transverse to the longitudinal axis of an associated trench (not shown).
Figure 7:
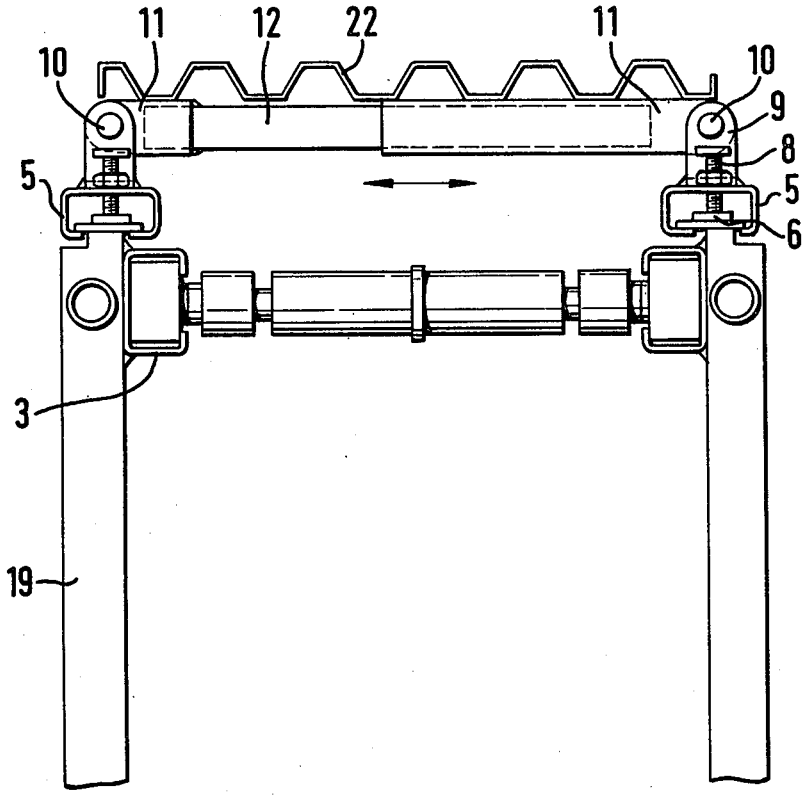
FIG. 7 is a top plan view showing a pair of excavation plates at the end of a trench with the supporting beam of this invention spanning the excavation plates carrying corrugated sheeting or trenching to support the end of the trench against collapsing.

In FIG. 6 of the drawing, two pairs of excavation plates or walls 19, 19 are each in alignment with an excavation plate or wall 20, 20 and they are held by conventional spreaders (unnumbered) received in the guides 3 with the spreader bars 12 of the invention being shown between each of the spaced excavation plates 19, 20. Reference numeral 21 indicates a conduit which is passing generally transversely through the trench (unnumbered) which is supported by the excavation walls 19, 20. Preferably corrugated sheeting 22 is applied to the exterior surfaces of the spreader bars 12 to further support the trenching while allowing gaps (unnumbered) between the corrugating sheeting 22 through which the conduit 21 may project in the manner readily evident in this figure. In FIG. 7 like excavating walls 19, 19 in parallel relationship to each other are spanned by a spreader (unnumbered) disposed between vertical guides 3. In this case, the supporting beam 12 stands across the ends of the excavation walls 19, 19 at the end of a trench and may have resting thereagainst or otherwise secured thereto like corrugated sheeting 22 for supporting the blind wall (not shown) of the associated trench.

Figure 8:
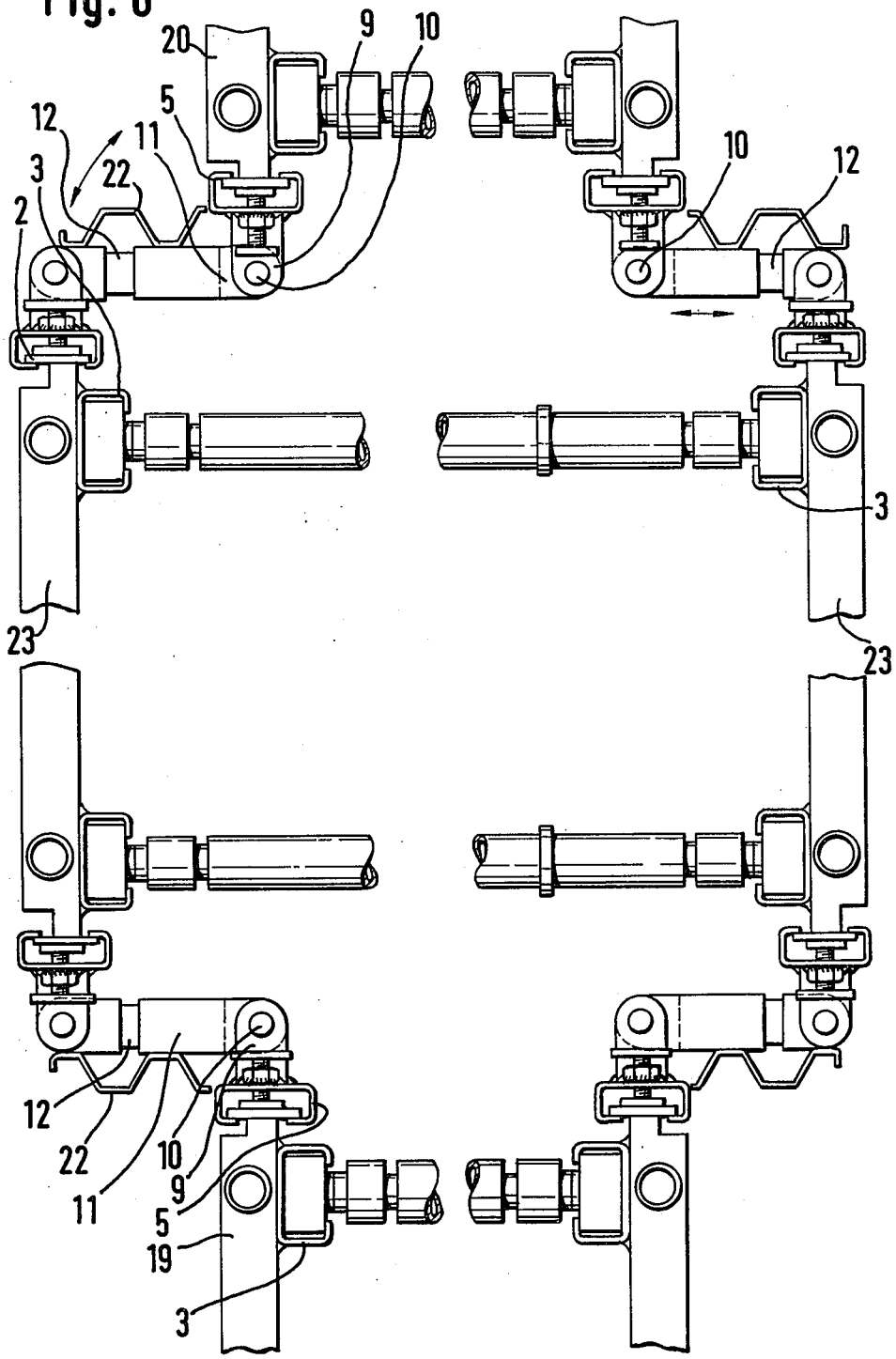
FIG. 8 is a top plan view of two pair of aligned excavation plates located in narrower portions of a trench (not shown), another pair of excavation plates in a wider area of the trench, and four spreader bars of this invention connecting together adjacent ends of the excavation plates.

In FIG. 8 the upper excavating walls 20, 20 are in alignment with the lower walls 19, 19 and represent narrow portions of a trench whereas excavating walls 23, 23 represent a widening portion of an associated trench (not shown) with the adjacent vertical edges of these excavating walls 20, 23; 19, 23, etc. being interconnected by the spreader bars 12 of this invention along with associated corrugated sheeting therebetween. In this manner, the construction heretofore described including the pivots 10 and the C-shaped clamping means 5 permit support between narrowing and widening portions of vertical trenching.

Although only a preferred embodiment of the invention has been specifically illustrated and described herein, it is to be understood that minor variations may be made in the apparatus or in the method of without departing from the spirit and scope of the invention, as defined in the appended claims.

I claim:

1. A supporting beam particularly adapted for bracing purposes in construction applications comprising at least one elongated member having axially opposite end portions, a generally C-shaped bracket at each of said end portions, means for pivotally mounting each of said C-shaped brackets relative to the associated end portions of said elongated member, each of said C-shaped brackets being defined by a bight and a pair of legs with the latter setting off therebetween an associated elongated groove, each elongated groove having a longitudinal axis, a width, and a depth; each groove width being defined as that dimension between said legs and normal thereto, each groove depth being defined as that dimension mormal to and outwardly from each said bight, each longitudinal axis being defined as that axis normal to both the length and width dimensions and parallel to said legs, the longitudinal axis of each of said grooves being disposed generally parallel to the axes of said pivot mounting means, each of said C-shaped bracket legs terminate in opposing end walls defining therebetween an associated one of said grooves, and means carried by said bight of each of said C-shaped brackets for clamping an element to be braced against said end walls.

2. The supporting beam as defined in claim 1 wherein said end walls have inner and outer surfaces, and said clamping means carried by said bight of each of said C-shaped brackets clamp an element to be braced against said end wall inner surfaces.

3. The supporting beam as defined in claim 1 wherein said end walls have inner and outer surfaces, and said clamping means carried by said bight of each of said C-shaped brackets clamp an element to be braced against said end wall outer surfaces.

4. The support beam as defined in claim 1 wherein said end walls have inner and outer surfaces, and said clamping means include first and second clamping means carried by the bight of each of said C-shaped brackets for selectively clamping an element to be braced against said inner or outer end wall surfaces.

5. A supporting beam particularly adapted for bracing purposes in construction applications comprising at least one elongated member having axially opposite end portions, a generally C-shaped bracket at each of said end portions, means for pivotally mounting each of said C-shaped brackets relative to the associated end portions of said elongated member, each of said C-shaped brackets being defined by a bight and a pair of legs with the latter setting off therebetween an associated elongated groove, each elongated groove having a longitudinal axis, a width, and a depth; each groove width being defined as that dimension between said legs and normal thereto, each groove depth being defined as that dimension normal to and outwardly from each said bight, each longitudinal axis being defined as that axis normal to both the length and width dimensions and parallel to said legs, the longitudinal axis of each of said grooves being disposed generally parallel to the axes of said pivot mounting means, a cover plate secured to one leg of each of said pair of legs, and each said one leg terminating in an end wall disposed generally normal to its associated cover plate.

6. A supporting beam particularly adapted for bracing purposes in construction applications comprising at least one elongated member having axially opposite end portions, a generally C-shaped bracket at each of said end portions, means for pivotally mounting each of said C-shaped brackets relative to the associated end portions of said elongated member, each of said C-shaped brackets being defined by a bight and a pair of legs with the latter setting off therebetween an associated elongated groove, each elongated groove having a longitudinal axis, a width, and a depth; each groove width being defined as that dimension between said legs and normal thereto, each groove depth being defined as that dimension normal to and outwardly from each said bight, each longitudinal axis being defined as that axis normal to both the length and width dimensions and parallel to said legs, the longitudinal axis of each of said grooves being disposed generally parallel to the axes of said pivot mounting means, an elongated slot in each bight disposed with its longitudinal axis generally normal to its associated groove longitudinal axis, and clamping means housed at least in part in and movable relative to said slot for clamping an element to be braced against each of said C-shaped brackets.

7. A supporting beam particularly adapted for bracing purposes in construction applications comprising at least one elongated member having axially opposite end portions, a generally C-shaped bracket at each of said end portions, means for pivotally mounting each of said C-shaped brackets relative to the associated end portions of said elongated member, each of said C-shaped brackets being defined by a bight and a pair of legs with the latter setting off therebetween an associated elongated groove, each elongated groove having a longitudinal axis, a width, and a depth; each groove width being defined as that dimension between said legs and normal thereto, each groove depth being defined as that dimension normal to and outwardly from each said bight, each longitudinal axis being defined as that axis normal to both the length and width dimensions and parallel to said legs, the longitudinal axis of each of said grooves being disposed generally parallel to the axes of said pivot mounting means, first and second clamping means carried by the bight of each of said C-shaped brackets for individually or collectively clamping an element to be braced against each of said C-shaped bracket.

8. A supporting beam particularly adapted for bracing purpose in construction applications comprising at least one elongated member having axially opposite end portions, a generally C-shaped bracket at each of said end portions, means for pivotally mounting said C-shaped brackets relative to the associated end portions of said elongated member, each said C-shaped brackets being defined by a bight and a pair of legs with the latter setting-off therebetween an associated elongated groove, each elongated groove having a longitudinal axis, a width, a depth; each groove width being defined as that dimension between said legs and normal thereto, each groove depth being defined as that dimension normal to and outwardly from each said bight, each longitudinal axis being defined as that axis normal to both the length and width dimensions and parallel to said legs, longitudinal axes of said grooves being disposed generally parallel to the axes of said pivot mounting means, means for variably adjusting the length of said at least one elongated member, each C-shaped bracket legs terminate in opposing end walls defining therebetween an associated one of said grooves, and means carried by said bight of each C-shaped brackets for clamping an element to be braced against said end walls.

9. A supporting beam particularly adapted for bracing purpose in construction applications comprising at least one elongated member having axially opposite end portions, a generally C-shaped bracket at each of said end portions, means for pivotally mounting said C-shaped brackets relative to the associated end portions of said elongated member, each said C-shaped brackets being defined by a bight and a pair of legs with the latter setting-off therebetween an associated elongated groove, each elongated groove having a longitudinal axis, a width, a depth; each groove width being defined as that dimension between said legs and normal thereto, each groove depth being defined as that dimension normal to and outwardly from each said bight, each longitudinal axis being defined as that axis normal to both the length and width dimensions and parallel to said legs, longitudinal axes of said grooves being disposed generally parallel to the axes of said pivot mounting means, means for variably adjusting the length of said at least one elongated member, each C-shaped bracket legs terminate in opposing and walls defining therebetween an associated one of said grooves, said end walls having inner and outer surfaces, and means carried by said bight of each C-shaped bracket for clamping an element to be braced against said end wall inner surface.

10. A supporting beam particularly adapted for bracing purpose in construction applications comprising at least one elongated member having axially opposite end portions, a generally C-shaped bracket at each of said end portions, means for pivotally mounting said C-shaped brackets relative to the associated end portions of said elongated member, each said C-shaped brackets being defined by a bight and a pair of legs with the latter setting-off therebetween an associated elongated groove, each elongated groove having a longitudinal axis, a width, a depth; each groove width being defined as that dimension between said legs and normal thereto, each groove depth being defined as that dimension normal to and outwardly from each said bight, each longitudinal axis being defined as that axis normal to both the length and width dimensions and parallel to said legs, longitudinal axes of said grooves being disposed generally parallel to the axes of said pivot mounting means, means for variably adjusting the length of said at least one elongated member, each C-shaped bracket legs terminate in opposing end walls defining therebetween an associated one of said grooves, said end walls having inner and outer surfaces, and means carried by said bight of each C-shaped brackets for clamping an element to be braced against said end wall outer surfaces.

11. A supporting beam particularly adapted for bracing purpose in construction applications comprising at least one elongated member having axially opposite end portions, a generally C-shaped bracket at each of said end portions, means for pivotally mounting said C-shaped brackets relative to the associated end portions of said elongated member, each said C-shaped brackets being defined by a bight and a pair of legs with the latter setting-off therebetween an associated elongated groove, each elongated groove having a longitudinal axis, a width, a depth; each groove width being defined as that dimension between said legs and normal thereto, each groove depth being defined as that dimensional normal to and outwardly from each said bight, each longitudinal axis being defined as that axis normal to both the length and width dimensions and parallel to said legs, longitudinal axes of said grooves being disposed generally parallel to the axes of said pivot mounting means, means for variably adjusting the length of said at least one elongated member, a cover plate secured to one leg of each of said pair of legs, and each said one leg terminating in an end wall disposed generally normal to its associated cover plate.

12. A supporting beam particularly adapted for bracing purpose in construction applications comprising at least one elongated member having axially opposite end portions, a generally C-shaped bracket at each of said end portions, means for pivotally mounting said C-shaped brackets relative to the associated end portions of said elongated member, each said C-shaped brackets being defined by a bight and a pair of legs with the latter setting-off therebetween an associated elongated groove, each elongated groove having a longitudinal axis, a width, a depth; each groove width being defined as that dimension between said legs and normal thereto, each groove depth being defined as that dimension normal to and outwardly from each said bight, each longitudinal axis being defined as that axis normal to both the length and width dimensions and parallel to said legs, longitudinal axes of said grooves being disposed generally parallel to the axes of said pivot mounting means, said pivotal mounting means being individual pivot pins removably securing together said C-shaped brackets and said elongated member end portions, each C-shaped bracket legs terminate in opposing end walls defining therebetween an associated one of said grooves, and means carried by said bight of each C-shaped brackets for clamping an element to be braced against said end walls.

13. A supporting beam particularly adapted for bracing purpose in construction applications comprising at least one elongated member having axially opposite end portions, a generally C-shaped bracket at each of said end portions, means for pivotally mounting said C-shaped brackets relative to the associated end portions of said elongated member, each said C-shaped brackets being defined by a bight and a pair of legs with the latter setting-off therebetween an associated elongated groove, each elongated groove having a longitudinal axis, a width, a depth; each groove width being defined as that dimension between said legs and normal thereto, each groove depth being defined as that dimension normal to and outwardly from each said bight, each longitudinal axis being defined as that axis normal to both the length and width dimensions and parallel to said legs, longitudinal axes of said grooves being disposed generally parallel to the axes of said pivot mounting means, said pivotal mounting means being individual pivot pins removably securing together said C-shaped brackets and said elongated member end portions, each C-shaped bracket legs terminate in opposing end walls defining therebetween an associated one of said grooves, said end walls having inner and outer surfaces, and means carried by said bight of each C-shaped brackets for clamping an element to be braced against said end wall inner surfaces.

14. A supporting beam particularly adapted for bracing purpose in construction applications comprising at least one elongated member having axially opposite end portions, a generally C-shaped bracket at each of said end portions, means for pivotally mounting said C-shaped brackets relative to the associated end portions of said elongated member, each said C-shaped brackets being defined by a bight and a pair of legs with the latter setting-off therebetween an associated elongated groove, each elongated groove having a longitudinal axis, a width, a depth; each groove width being defined as that dimension between said legs and normal thereto, each groove depth being defined as that dimension normal to and outwardly from each said bight, each longitudinal axis being defined as that axis normal to both the length and width dimensions and parallel to said legs, longitudinal axes of said grooves being disposed generally parallel to the axes of said pivot mounting means, said pivotal mounting means being individual pivot pins removably securing together said C-shaped brackets and said elongated member end portions, each C-shaped bracket legs terminate in opposing end walls defining therebetween an associated one of said grooves, said end walls having inner and outer surfaces, and means carried by said bight of each C-shaped brackets for clamping an element to be braced against said end wall outer surfaces.

15. A supporting beam particularly adapted for bracing purposes in construction applications comprising at least one elongated member having axially opposite end portions, a generally C-shaped bracket at each of said end portions, means for pivotally mounting each of said C-shaped brackets relative to the associated end portions of said elongated member, each of said C-shaped brackets being defined by a bight and a pair of legs with the latter setting off therebetween an associated elongated groove, each elongated groove having a longitudinal axis, a width, and a depth; each groove width being defined as that dimension between said legs and normal thereto, each groove depth being defined as that dimension normal to and outwardly from each said bight, each longitudinal axis being defined as that axis normal to both the length and width dimensions and parallel to said legs, the longitudinal axis of each of said grooves being disposed generally parallel to the axes of said pivot mounting means, each of said C-shaped bracket legs terminates in opposing end walls defining therebetween an associated one of said grooves of a predetermined width, an excavation plate carrying a guide head housed within at least one of said C-shaped brackets, said guide head having a width greater than that of said one C-shaped bracket groove, and means carried by said one C-shaped bracket bight for clamping said guide head against said one C-shaped bracket groove end walls.

16. The supporting beam as defined in claim 15 wherein said clamping means is a screw.

17. A supporting beam particularly adapted for bracing purposes in construction applications comprising at least one elongated member having axially opposite end portions, a generally C-shaped bracket at each of said end portions, means for pivotally mounting said C-shaped brackets relative to the associated end portions of said elongated member, each said C-shaped brackets being defined by a bight and a pair of legs with the latter setting-off therebetween an associated elongated groove, each C-shaped bracket legs terminating in opposing end walls defining therebetween an associated one of said grooves of a predetermined width, said end walls having inner and outer surfaces, an excavation plate having a portion spanning the groove of one of said C-shaped brackets, and means carried by said one C-shaped bracket bight for clamping said excavation plate portion against one of said end wall inner and outer surfaces.

18. The supporting beam as defined in claim 17 wherein said excavation plate portion is a guide head housed within the groove of said one C-shaped bracket, said guide head having a width generally greater than that of said one C-shaped bracket groove, and said clamping means clamp said guide head against said end wall inner surfaces.

19. The supporting beam as defined in claim 17 wherein said excavation plate portion rests against said end wall outer surfaces in spanning relationship to said groove, and said clamping means clamp said excavation plate portion against said end wall outer surfaces.

20. The supporting beam as defined in claim 18 wherein said clamping means is a screw.

21. The supporting beam as defined in claim 19 wherein said clamping means is a screw.

* * * * *